US010323515B1

(12) United States Patent
Sollami

(10) Patent No.: US 10,323,515 B1
(45) Date of Patent: Jun. 18, 2019

(54) TOOL WITH STEEL SLEEVE MEMBER

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 108 days.

(21) Appl. No.: 15/332,150

(22) Filed: Oct. 24, 2016

Related U.S. Application Data

(60) Continuation-in-part of application No. 15/261,277, filed on Sep. 9, 2016, and a continuation-in-part of application No. 15/220,607, filed on Jul. 27, 2016, and a continuation-in-part of application No. 15/220,569, filed on Jul. 27, 2016, and a continuation-in-part of application No. 15/220,595, filed on Jul. 27, 2016, and a continuation-in-part of application No. 14/719,638, filed on May 22, 2015, and a continuation-in-part of application No. 14/714,547, filed on May 18, 2015, now Pat. No.
(Continued)

(51) Int. Cl.

| | |
|---|---|
| ***E21C 35/18*** | (2006.01) |
| ***E21C 35/183*** | (2006.01) |
| ***E21C 35/197*** | (2006.01) |
| *E01C 23/088* | (2006.01) |
| *E01C 23/12* | (2006.01) |

(52) U.S. Cl.
CPC ..... *E21C 35/197* (2013.01); *E21C 35/18* (2013.01); *E01C 23/088* (2013.01); *E01C 23/127* (2013.01); *E21C 35/183* (2013.01); *E21C 2035/1803* (2013.01); *E21C 2035/1806* (2013.01); *E21C 2035/1813* (2013.01); *E21C 2035/1816* (2013.01)

(58) Field of Classification Search
CPC ..... E21C 35/18; E21C 2035/1803; E21C 2035/1806; E21C 2035/1809; E21C 2035/1813; E21C 2035/1816; E21C 35/19; E21C 2035/191; E21C 35/197; E21C 35/183
See application file for complete search history.

(56) References Cited

U.S. PATENT DOCUMENTS

| | | | |
|---|---|---|---|
| 3,397,012 A | 8/1968 | Krekeler | |
| 3,519,309 A | 7/1970 | Engle | |

(Continued)

FOREIGN PATENT DOCUMENTS

| | | | |
|---|---|---|---|
| DE | 2849711 A1 * | 6/1979 | ..... E21C 35/183 |
| DE | 102004049710 | 4/2006 | |

(Continued)

*Primary Examiner* — Janine M Kreck
*Assistant Examiner* — Michael A Goodwin
(74) *Attorney, Agent, or Firm* — Mercedes V. O'Connor; Rockman Videbeck & O'Connor, LLC

(57) ABSTRACT

A bit holder having a body that includes a forward end that is diametrically smaller than a lower end and a shank depending axially from the lower end of the body. A substantial portion of the body is substantially solid and the shank is generally cylindrical with a bore axially extending from a distal end of the shank towards the lower end of the body. The bit holder also includes an annular sleeve mounted circumferentially around the upper end of the body and is configured protect the upper end of the body and is configured to receive a bit or insert.

10 Claims, 5 Drawing Sheets

Related U.S. Application Data

9,518,464, and a continuation-in-part of application No. 14/487,493, filed on Sep. 16, 2014, now Pat. No. 9,909,416, said application No. 14/714,547 is a division of application No. 13/801,012, filed on Mar. 13, 2013, now Pat. No. 9,039,099, said application No. 14/719,638 is a continuation-in-part of application No. 13/801,012.

(60) Provisional application No. 62/237,070, filed on Oct. 5, 2015, provisional application No. 61/879,353, filed on Sep. 18, 2013, provisional application No. 61/716,243, filed on Oct. 19, 2012.

(56) References Cited

U.S. PATENT DOCUMENTS 3,865,437 A 2/1975 Crosby
4,084,856 A * 4/1978 Emmerich ..... E21C 35/197 175/354
4,247,150 A 1/1981 Wrulich et al.
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,694,918 A 9/1987 Hall
4,763,956 A 8/1988 Emmerich
4,811,801 A 3/1989 Salesky
4,818,027 A 4/1989 Simon
4,821,819 A * 4/1989 Whysong ..... B23K 31/025 228/122.1
4,844,550 A 7/1989 Beebe
4,915,455 A 4/1990 O'Neill
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A * 1/1996 Sollami ..... E21B 10/567 299/105
5,492,188 A 2/1996 Smith et al.
5,551,760 A * 9/1996 Sollami ..... E21B 10/567 299/105
5,607,206 A 3/1997 Siddle
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A * 8/2000 Briese ..... E21C 35/183 299/111
6,176,552 B1 1/2001 Topka, Jr.
6,250,535 B1 6/2001 Sollami
6,331,035 B1 12/2001 Montgomery, Jr.
6,357,832 B1 3/2002 Sollami
6,371,567 B1 4/2002 Sollami
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall

(56) References Cited

U.S. PATENT DOCUMENTS

| | | | | |
|---|---|---|---|---|
| 8,414,085 | B2 | 4/2013 | Hall | |
| 8,449,039 | B2 | 5/2013 | Hall | |
| 8,485,609 | B2 | 7/2013 | Hall | |
| 8,500,209 | B2 | 8/2013 | Hall | |
| 8,540,320 | B2 | 9/2013 | Sollami | |
| RE44,690 | E | 1/2014 | Sollami | |
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 2002/0167216 | A1 | 11/2002 | Sollami | |
| 2003/0015907 | A1 | 1/2003 | Sollami | |
| 2003/0047985 | A1 | 3/2003 | Stiffler | |
| 2003/0052530 | A1* | 3/2003 | Sollami | B28D 1/188 299/111 |
| 2003/0122414 | A1* | 7/2003 | Sollami | B28D 1/188 299/113 |
| 2004/0004389 | A1 | 1/2004 | Latham | |
| 2004/0174065 | A1 | 9/2004 | Sollami | |
| 2005/0212345 | A1* | 9/2005 | Sleep | E21C 35/197 299/105 |
| 2006/0071538 | A1 | 4/2006 | Sollami | |
| 2006/0186724 | A1 | 8/2006 | Stehney | |
| 2007/0040442 | A1* | 2/2007 | Weaver | E21C 35/183 299/106 |
| 2008/0035386 | A1 | 2/2008 | Hall et al. | |
| 2008/0164747 | A1* | 7/2008 | Weaver | E21C 35/183 299/10 |
| 2009/0146491 | A1* | 6/2009 | Fader | B28D 1/186 299/105 |
| 2009/0261646 | A1 | 10/2009 | Ritchie et al. | |
| 2010/0244545 | A1 | 9/2010 | Hall | |
| 2010/0253130 | A1 | 10/2010 | Sollami | |
| 2011/0006588 | A1 | 1/2011 | Monyak et al. | |
| 2011/0089747 | A1 | 4/2011 | Helsel | |
| 2011/0204703 | A1 | 8/2011 | Sollami | |
| 2011/0254350 | A1 | 10/2011 | Hall | |
| 2012/0027514 | A1 | 2/2012 | Hall | |
| 2012/0068527 | A1 | 3/2012 | Erdmann | |
| 2012/0181845 | A1 | 7/2012 | Sollami | |
| 2012/0242136 | A1* | 9/2012 | Ojanen | E21C 35/18 299/105 |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0199693 | A1* | 8/2013 | Tank | B05B 1/00 156/60 |
| 2014/0262541 | A1* | 9/2014 | Parsana | E21B 10/567 175/428 |
| 2014/0326516 | A1 | 11/2014 | Haugvaldstad | |
| 2015/0028656 | A1 | 1/2015 | Sollami | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0194956 | A1 | 7/2016 | Sollami | |
| 2017/0089198 | A1 | 3/2017 | Sollami | |

FOREIGN PATENT DOCUMENTS

| | | | |
|---|---|---|---|
| DE | 102011079115 | | 1/2013 |
| DE | 202012100353 | | 6/2013 |
| DE | 102015121953 | | 7/2016 |
| DE | 102016118658 | | 3/2017 |
| GB | 2483157 | | 2/2012 |
| WO | 2008105915 | A2 | 9/2008 |
| WO | 2008105915 | A3 | 9/2008 |
| WO | 2009006612 | | 1/2009 |

* cited by examiner

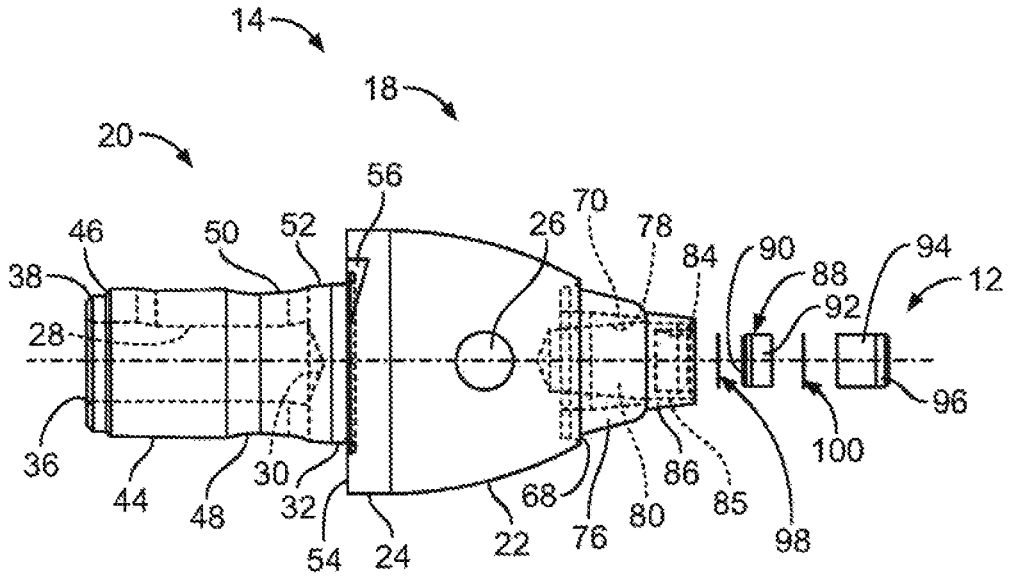
FIG. 5
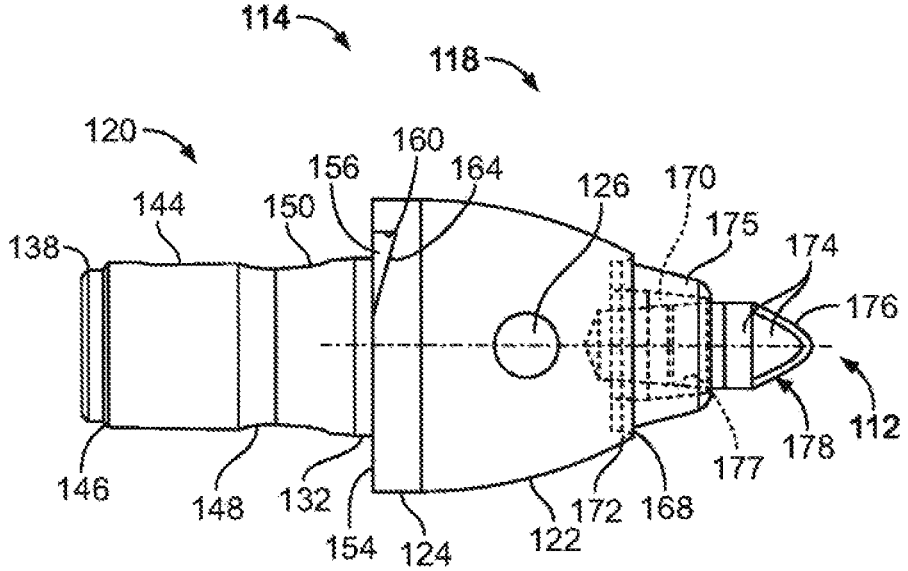
FIG. 6
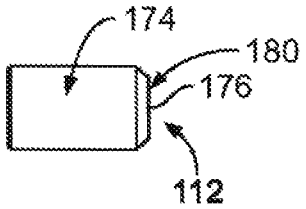

TOOL WITH STEEL SLEEVE MEMBER

CROSS-REFERENCE TO RELATED APPLICATION(S)

This application claims priority to and is a continuation-in-part of U.S. Non-provisional application Ser. No. 15/261,277, filed Sep. 9, 2016, and U.S. Non-provisional application Ser. No. 15/261,277 claims priority to U.S. Provisional Application No. 62/237,070, filed Oct. 5, 2015; this application claims priority to and is a continuation-in-part of U.S. Non-provisional application Ser. No. 14/719,638, filed May 22, 2015, U.S. Non-provisional application Ser. No. 14/719,638 claims priority to and is a continuation-in-part of U.S. Non-provisional application Ser. No. 13/801,012, filed Mar. 13, 2013, now U.S. Pat. No. 9,039,099, issued May 26, 2015, and U.S. Non-provisional application Ser. No. 13/801,012 claims priority to U.S. Provisional Application No. 61/716,243, filed Oct. 19, 2012; this application claims priority to and is a continuation-in-part of U.S. Non-provisional application Ser. No. 14/714,547, filed May 18, 2015, U.S. Non-provisional application Ser. No. 14/714,547 claims priority to and is a division of U.S. Non-Provisional application Ser. No. 13/801,012, filed Mar. 13, 2013, now U.S. Pat. No. 9,039,099, issued May 26, 2015, and U.S. Non-provisional application Ser. No. 13/801,012 claims priority to U.S. Provisional Application No. 61/716,243, filed Oct. 19, 2012; this application claims priority to and is a continuation-in-part of U.S. Non-provisional application Ser. No. 14/487,493, filed Sep. 16, 2014, and U.S. Non-provisional application Ser. No. 14/487,493 claims priority to U.S. Provisional Application 61/879,353, filed Sep. 18, 2013; this application claims priority to and is a continuation-in-part to U.S. Non-provisional application Ser. No. 15/220,569, filed Jul. 27, 2016; this application claims priority to and is a continuation-in-part to U.S. Non-provisional application Ser. No. 15/220,595, filed Jul. 27, 2016; and this application claims priority to and is a continuation-in-part to U.S. Non-provisional application Ser. No. 15/220,607, filed Jul. 27, 2016, to the extent allowed by law and the contents of which are incorporated herein by reference in their entireties.

TECHNICAL FIELD

This disclosure relates to a steel sleeve member for bit assemblies used in road milling, mining, and trenching equipment.

BACKGROUND

Originally, road milling equipment was used to smooth out bumps on the surface of a roadway or to grind down the joinder of two adjacent concrete slabs that may have buckled. Now, these road milling machines are also used for completely degrading concrete and macadam roads down to their gravel base. Additionally, the road milling equipment can be used for trenching and mining operations. The combinations of bit assemblies have been utilized for a wide variety of operations, such as to remove material from the terra firma, such as degrading the surface of the earth, minerals, cement, concrete, macadam or asphalt pavement.

Road milling, mining, and trenching equipment are operated using a rotatable, cylindrical drum that includes a plurality of bit holder blocks mounted onto the drum in a herringbone, V-shape, or spiral configuration. Bits are traditionally set in a bit assembly having a bit holder that is retained within a bore of the bit holder block. Bits can include an insert having a conical cutting tip that is mounted in a recess in a frustoconical forward body portion of the bit. The insert can be made of a hardened material and/or can be surrounded by a hardened annular collar that provides added wear resistance to the cutting tool. The insert is further protected by a metal or steel sleeve. The cutting tool can include a solid generally cylindrical shank that extends axially rearwardly from the forward body portion. The bit fits in a central bore of the bit holder. As described, these bit holders are frictionally seated in the bores of their respective bit holder blocks mounted on the drums. These bit holders are not held in the bores of their respective bit holder blocks by retaining clips or threaded nuts, thereby providing easier removal and replacement once the bit holders are worn through use or broken due to the harsh road degrading environment.

Historically, these bits and bit holders have been made of steel with hardened metal or tungsten carbide tips or collars to lengthen the useful service life of the bit holder. Heavy duty road milling, mining, and trenching operations, however, impose much more wear and tear than the currently used industry standard bit holders can handle. The forces and vibrations exerted on the bit assemblies from the harsh road degrading environment may cause the bit holder to move within the bore of the bit holder block. Individual bits may wear or be broken off of their shanks because of the harsh environment and may also lead to the need to replace the bit holder.

Recently, materials harder than tungsten carbide, such as polycrystalline diamond or the like, have been used in certain road milling operations, notably the degradation of asphalt layers on long roadway stretches. While the hardness of the polycrystalline diamond tip lengthens the useful life of the combined bit and bit holder, the polycrystalline diamond tip of the combination is so brittle that it is generally not suitable for use in degrading concrete highways or curved highway stretches, such as cloverleafs and the like.

To prolong the life of the polycrystalline diamond tip bit assembly and prevent damage to the bit assemblies in heavy duty operations, a heavy duty combination bit and bit holder is provided that is sturdy enough to withstand the forces found when degrading or breaking up the surfaces of not only macadam (asphalt) roadways but also concrete roadways. Additionally, the metal sleeve supports both transverse and angular loads on the vertically exposed portion of the insert, which shields the forward end of the insert. The addition of this metal sleeve offers support and allows greater extension of the insert from the forward end. Most importantly, the metal sleeve significantly speeds the heat transfer in the induction brazing process and limits the polycrystalline diamond from excessive heat buildup which reduces degradation. The heat generated when the polycrystalline diamond is removing macadam, for example, dissipates faster through the metal sleeve, which will significantly increase the useful service life, by at least double, of a polycrystalline diamond insert brazed atop of a tungsten carbide bolster.

SUMMARY

This disclosure relates generally to bit assemblies for road milling, mining, and in particular trenching equipment. One implementation of the teachings herein is a bit holder for road milling machinery that includes a substantially solid body having an upper end and a lower end, the upper end being diametrically smaller than the lower end; a generally cylindrical hollow shank depending axially from the lower end, the shank having a bore axially extending from a distal end of the shank toward the forward body portion; and a steel annular sleeve disposed circumferentially around the upper end of the body, the sleeve configured to receive a bit.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

FIG. 5 is a detail exploded side elevation view of the first embodiment of the bit holder, showing a first braze disc, a metal cup, a second braze disk, and the bit or insert;

FIG. 6 is a detail side elevation view of a second embodiment of a bit assembly showing a bit or insert, with a frustoconical forward end, attached to a bit holder and a bit or insert with a flat generally cylindrical puck forward end.

DETAILED DESCRIPTION

Figure 1:
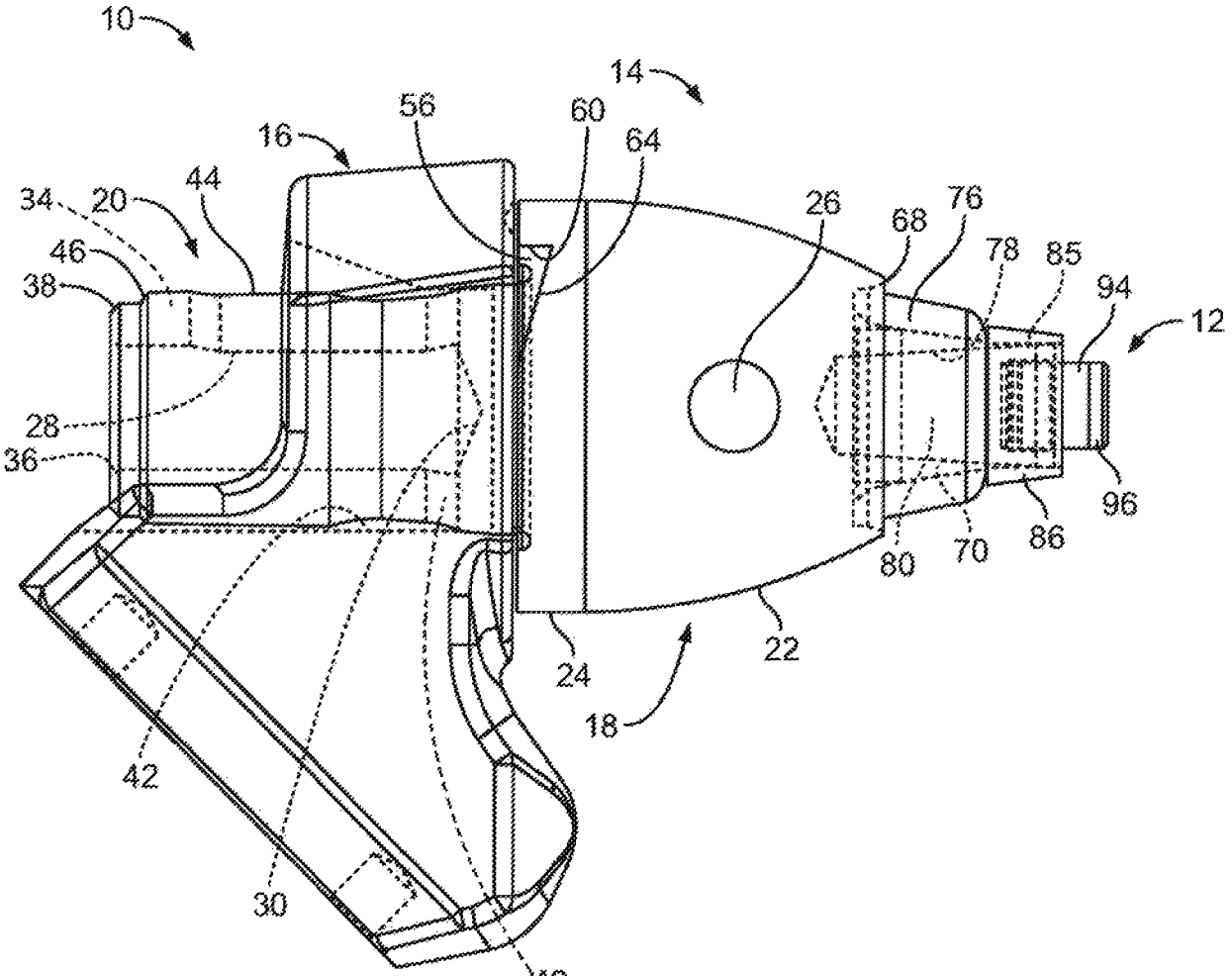
FIG. 1 is a detail side elevation view of a first embodiment of a bit assembly showing a bit or insert, a bit holder, and a bit holder block.

Road milling, mining, and trenching equipment are operated using a rotatable, cylindrical drum that includes a plurality of bit holder blocks mounted onto the drum in a herringbone, V-shape, or spiral configuration. Bits are traditionally set in a bit assembly having a bit holder that is retained within the bit holder block. The bit is retained by the bit holder and a shank of the bit holder is retained within a bore in the bit holder block. Bits can include an insert having a conical cutting tip that is mounted in a recess in a frustoconical forward body portion of the bit. The insert can be made of a hardened material and/or can be surrounded by a hardened annular collar that provides added wear resistance to the cutting tool. The insert is further protected by a metal or steel sleeve. The cutting tool can include a solid generally cylindrical shank that extends axially rearwardly from the forward body portion. The bit fits in a central bore of the bit holder. As described, these bit holders are frictionally seated in the bores of their respective bit holder blocks mounted on the drums, thereby providing easier removal and replacement once the bit holders are worn through use or broken due to the harsh road degrading environment.

The combinations of bit assemblies have been utilized to remove material from the terra firma, such as degrading the surface of the earth, minerals, cement, concrete, macadam or asphalt pavement. Individual bits, bit holders, and bit holder blocks may wear down or break over time due to the harsh road trenching environment. Bit holder blocks, herein after referred to as base blocks, are generally made of steel. Tungsten carbide and diamond or polycrystalline diamond coatings, which are much harder than steel, have been used to prolong the useful life of bits and bit holders. However, while polycrystalline diamond layers and coatings have a hardness that lengthens the useful life of the combined bit and bit holder, the polycrystalline diamond tip of the combination is so brittle that it is not economically suitable for use in degrading concrete highways or curved highway stretches.

To prolong the life of the polycrystalline diamond tip bit assembly and prevent damage to the bit assemblies in heavy duty operations, a heavy duty combination bit and bit holder is provided that is sturdy enough to withstand the forces found when degrading or breaking up the surfaces of not only macadam (asphalt) roadways but also concrete roadways. One important aspect of the present disclosure is that the metal sleeve supports both transverse and angular loads on the vertically exposed portion of the insert, which shields the forward end of the insert. The addition of this metal sleeve offers support and allows greater extension of the insert from the forward end. Another important aspect of the present disclosure is that the metal sleeve significantly speeds the heat transfer in the induction brazing process and limits the polycrystalline diamond from excessive heat buildup, which reduces degradation. The heat generated when the polycrystalline diamond is removing macadam, for example, dissipates faster through the metal sleeve, which significantly increases the useful service life, by at least double, of a polycrystalline diamond insert brazed atop of a tungsten carbide bolster.

Figure 2:
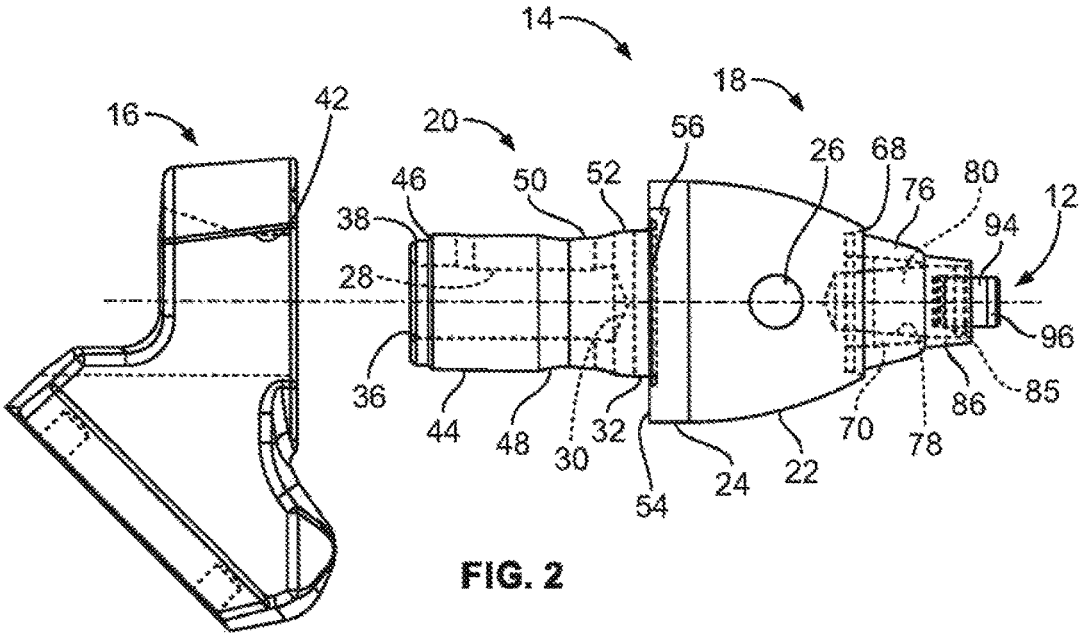
FIG. 2 is a detail exploded side elevation view of the first embodiment of the bit assembly, showing the assembled bit or insert and bit holder apart from the bit holder block.

Referring to FIGS. 1-5, a first embodiment of a bit assembly 10 (FIG. 1), or diamond tool, comprises a bit or insert 12 (FIGS. 1, 2, and 5), a bit holder 14, and a base block 16 (FIGS. 1 and 2). The combination bit and bit holder of the present disclosure is a unitary bit and bit holder construction that includes a bit holder body 18 and a generally cylindrical hollow shank 20 axially depending from the bottom of the bit holder body 18. In this embodiment, the bit holder body 18 is generally annular in shape and comprises an enlarged upper body 22 having a cylindrical base 24, termed in the trade as a tire portion, and a cylindrical side wall extending upwardly from the tire portion 24 to the upper body 22. The upper body 22 of the bit holder body 18, in this embodiment, is a generally convex surfaced solid structure. In other embodiments, the enlarged upper body 22 can have various shapes, such as having a generally frustoconical, concave, or arcuate surfaced solid structure. In this embodiment, the enlarged upper body 22 includes an aperture 26 that accepts a sleeve to facilitate the insertion of the bit holder 14 to the base block 16.

The bit holder body 18 of the bit/bit holder combination provides added bulk and strength to the entire unitary assembly which allows the bit/bit holder combination of the present disclosure to withstand substantial forces and stress superior to heretofore known bit holders or bit/bit holder combinations. The present disclosure may be utilized not only in the degrading and removal of macadam or asphalt from long straight stretches of roadway, but may also provide for the removal of concrete and other materials both in straight long stretches and in curved sections such as at corners, cloverleaf intersections, or the like.

The shank 20 includes a central bore 28 that longitudinally and axially extends throughout the shank 20 of the bit holder body 18 of the bit/bit holder combination. The central bore 28 terminates, in this embodiment, at bore termination 30 that is approximately at an upper end 32, shown in FIGS. 2-5, of the shank 20. A sidewall 34 (not shown) of the shank 20, created by the central bore 28, further includes an elongated slot 36 extending from a generally annular distal end 38 of the shank 20 axially upward or forward to an upper termination 40 (not shown) that is adjacent to the forward or upper end 32 of the shank 20. This allows the generally C-shaped annular sidewall 34 (not shown) of the shank 20 to radially contract when the shank 20 is mounted in one of a positively tapered, cylindrical, or negatively tapered base block bore 42, shown in FIGS. 1 and 2, in the base block 16.

The shank 20 includes a lower or first tapered portion 44 running axially from a stepped shoulder 46 adjacent the distal end 38 of the shank 20. The first tapered portion 44 runs upwardly or axially from the stepped shoulder 46 of the shank 20 and terminates generally mid slot 36 longitudinally. The shank 20 also includes a second tapered portion 48 separating the first tapered portion 44 from an upper or third tapered portion 50 which extends from the second tapered portion 48 a generally cylindrical upper or fourth portion 52 of the shank 20, as shown in FIGS. 2-5. The generally cylindrical fourth portion 52 extends from the third tapered portion 50 towards a generally annular back flange 54, shown in FIGS. 2-5, that denotes the base of the bit holder body 18 of the bit holder 14. In other embodiments, the fourth portion 52 can also be positively or negatively tapered.

The generally annular flange 54 includes a pair of tapered cutouts 56 (FIGS. 1-5), 58 (not shown), or wedge-shaped undercuts, to provide access and leverage for a tool to extract the bit holder 14 from the base block 16. The tapered cutouts 56, 58 are formed into the tire portion 24 and extend from the flange 54 subjacent to the tire portion 24. The tapered cutouts 56, 58 include a pair of parallel flat vertical inner surfaces 60 (FIGS. 1 and 4), 62 (not shown), respectively, and a pair of flat tapered top surfaces 64 (FIGS. 1 and 4), 66 (not shown), respectively. The outer edge of the flat tapered top surfaces 64, 66 is each arcuate in shape to follow the periphery of the tire portion 24.

Figure 3:
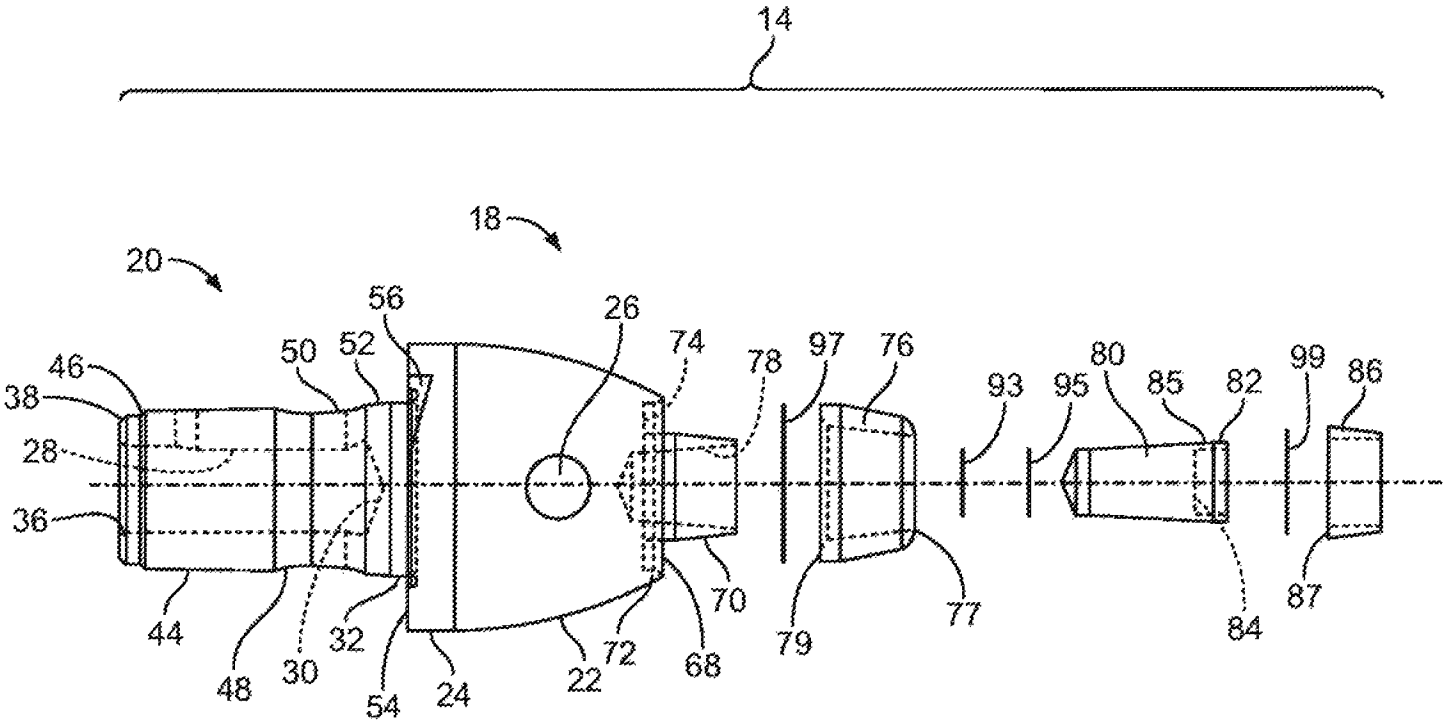
FIG. 3 is a detail exploded side elevation view of the first embodiment of the bit holder, without the bit, showing a bit holder body, a carbide collar, a carbide insert, and a metal sleeve.

The upper body 22 of the bit holder body 18 includes a generally annular top surface 68 positioned perpendicular to the axis of the bit holder 14 from the interior of which axially extends a smaller radially oriented annular tapered upper or forward extension 70. A forwardly extending annular collar 72 is created on the bit holder body 18 to provide an annular trough 74 around the tapered upper extension 70 of the bit holder body 18, as shown in FIG. 3. An annular carbide collar 76 is fitted around the tapered upper extension 70, which may be brazed into unitary construction with the remainder of the bit holder 14. A top or forwardmost portion of the carbide collar 76 and the annular tapered upper extension 70 of the upper body 22 terminate generally at the top of the bit holder body 18 of the combination bit/bit holder.

With the bit holder body 18 of the present disclosure preferably made of 4340 or equivalent steel, the top of the upper extension 70 of the upper body 22 includes a generally cylindrical or radially declining tapered bore 78 extending from the co-terminal upper wall of the body axially inwardly thereof which defines, in this illustrated embodiment, a declining radial taper. The tapered bore 78 extends a short distance longitudinally axially inwardly of the annular upper extension 70 that defines the base for the carbide collar 76. Bore 78 can also have a hollow cylindrical shape or a slight draw or draft angle.

The generally cylindrical or declining tapered bore 78 provides a space for receiving a complementary shaped positive generally cylindrical or declining tapered outer surface of a solid carbide insert 80 for the bit/bit holder combination. The carbide insert 80 for the bit also extends upwardly and is tapered outwardly axially longitudinally from the co-terminal upper extension 70 of the bit holder body 18 and includes an upper annular ring portion 82, shown in FIGS. 3 and 4, and a generally cylindrical bore 84, shown in FIGS. 3-5, positioned centrally and extending inwardly from the upper annular ring portion 82. In other embodiments, the carbide insert 80 can extend upwardly and be generally cylindrical or have a slight draft angle. An annular steel sleeve 86 is fitted around the outwardly extending portion of the carbide insert 80, which may be brazed into unitary construction with the remainder of the bit holder 14, as shown in FIG. 4.

Figure 4:
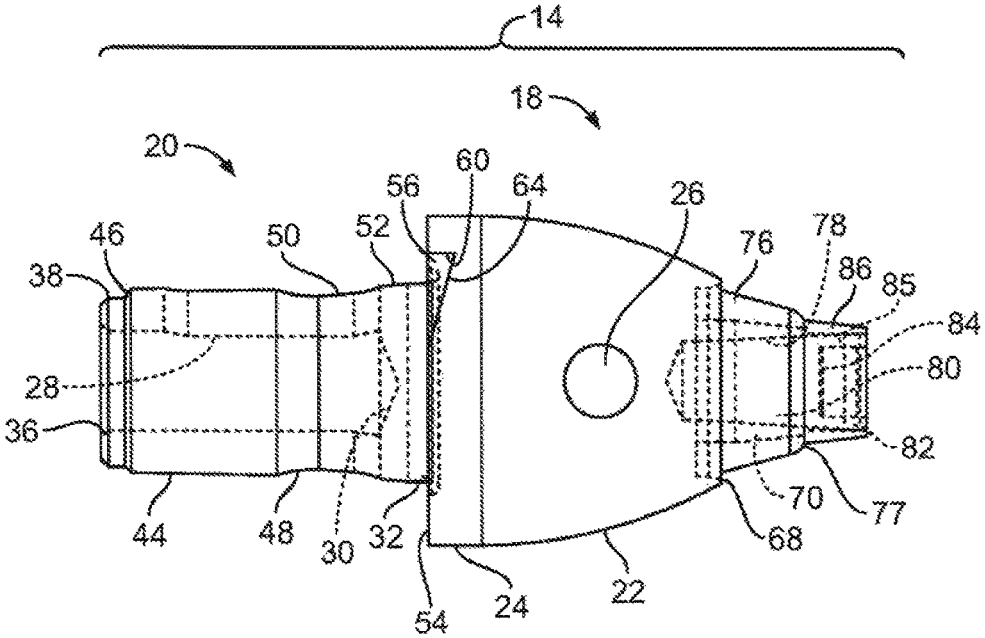
FIG. 4 is a detail side elevation view of the first embodiment of the bit holder, without the bit, assembled with the carbide collar, carbide insert, and metal sleeve.

The annular steel sleeve 86 supports transverse and/or angular loads on the vertically exposed portion of the carbide insert 80 that is positioned beyond a forward end 77, shown in FIGS. 3 and 4, of the carbide collar 76. The annular steel sleeve 86 also shields and protects the forward end, that extends past the carbide collar 76, of the carbide insert 80 where the generally cylindrical bore 84 is located because a thin carbide wall 85 of the carbide insert 80, created by the bore 84 of the carbide insert 80, will fracture and break apart when subject to even minor impacts. The addition of the annular steel sleeve 86 allows for greater extension of the carbide insert 80 from the forward end of the carbide collar 76 than permitted by previous designs.

A receiving cup 88, shown in FIG. 5, is mounted in the generally cylindrical bore 84 of the carbide insert 80. In this embodiment, the receiving cup 88 is made of steel and may have a thin bottom portion 90 and a hollow cup forward portion 92 into which a tip base 94, shown in FIGS. 1, 2, and 5, of a bit tip 12 may be positioned and brazed therein to provide a unitary structure. In other embodiments, the receiving cup 88 can be about ⅜-1 inch in height and include a thick bottom portion and a hollow cup forward portion. The reasoning behind the addition of the receiving cup 88 relates to the bond between the carbide to steel to carbide sequence, which yields substantially stronger bonds than brazing tungsten carbide to tungsten carbide alone.

The tip base 94 may be made of steel or tungsten carbide and includes a tip at the outer or upper end of the bit tip. In this embodiment, the outer surface or upper end 96, shown in FIGS. 1, 2, and 5, of tip 12 is made of a polycrystalline diamond structure. The tip 12 can have a frustoconical shape, a flat generally cylindrical puck shape (FIGS. 1, 2, and 5), or an arcuate shape. The upper end 96 of the bit tip 12 may also be made of an industrial diamond material and may be a coating or outer layer of such industrial diamond material, natural diamond, or polycrystalline diamond (PCD) material. The coating or layer may be formed of a high pressure, high temperature process.

The flat generally cylindrical puck shaped upper end 96 of the bit 12 of the bit holder 14, shown in FIGS. 1, 2, and 5, provides a substantially stronger tip that is able to withstand the added forces and peak jolts found in degrading concrete and the like, and together with the added bulk of the bit holder body 18 of the illustrated bit/bit holder combination in FIGS. 1-5, is capable of removing or degrading concrete surfaces with the added life expectancy shown in prior bit/bit holder constructions with PCD tips that have heretofore been utilized only in removing long straight stretches of macadam. The receiving cup 88 holding the puck-shaped tip 12 is also an impact absorbing member that can stretch and compress without fracturing. A road milling machine can travel faster with forward speed using the instant bit/bit holders than it can with bit holders having a strictly tungsten carbide forward end.

The bit assembly 10 is assembled using a two-step brazing process. Parts of the bit assembly 10, such as, for example, the annular trough 74, bore 78, carbide collar 76, carbide insert 80, steel sleeve 86, receiving cup 88, and tip 12, that are to be brazed together are first treated through a fluxing process. The parts are fluxed to clean, promote melting, and protect the parts from oxidation. In preparation for the brazing process, as shown in FIG. 3, a brazing ring 97 is positioned and mounted in the annular trough 74 of the bit holder body 18, the carbide collar 76 is positioned and mounted into the annular trough 74 such that the bottom portion 79 of the carbide collar 76 rests on the brazing ring 97, two brazing rings 93, 95 are positioned and located in the bottom of bore 78 of the forward extension 70 and around the carbide insert 80 that is inserted through the carbide collar 76 and is positioned and mounted into the bore 78 of the upper body 22, a brazing ring 99 is positioned around the forward end 77 of the carbide ring 76, and the steel sleeve 86 is positioned and mounted around the carbide insert 80 such that the bottom portion 87 of the steel sleeve 86 rests on the brazing ring 99. In this brazing process, the bit holder 14 assembly is brazed as an assembly in a one step process, shown in FIG. 4. The liquidus of the brazing rings 93, 95, 97, 99 material is at a brazing temperature of approximately 1900 degrees Fahrenheit (F). Once the bit holder 14 has cooled, the bit holder 14 is heat treated for hardening and tempering.

In preparation for this brazing process, a brazing disc 98 (FIG. 5) is positioned and mounted in the bore 84 of the carbide insert 80, the receiving cup 88 is positioned and mounted in the bore 84 of the carbide insert 80 such that the bottom portion 90 rests on the brazing disc 98, another brazing disc 100 (FIG. 5) is then positioned and mounted in the hollow cup forward portion 92 of the receiving cup 88, and the hardened tip 12 is then positioned and mounted in the hollow cup forward portion 92 of the receiving cup 88 such that the base 94 of the tip 12 rests on the brazing disc 100, as shown in FIG. 5. The fully assembled tool is then ready for the second brazing process. In this brazing process, the receiving cup 88 and hardened tip 12 are brazed in a one step process using the brazing discs 98, 100 positioned as shown in FIG. 5. The receiving cup 88 provides a carbide-steel-carbide sandwich that, when brazed together, is stronger than the combination of brazing the tungsten carbide insert directly to the tungsten carbide substrate of the hardened tip.

The annular steel sleeve 86 significantly speeds the heat transfer in the induction brazing process and limits the PCD insert or bit 12 from excessive heat buildup that causes degradation of cobalt to diamond and diamond to diamond bonds. The maximum temperature of the PCD insert or bit 12, which is brazed at the forward end of the carbide insert 80, is 1300 degrees F. in an open atmosphere brazing process. The liquidus of the brazing discs 98, 100 material is 1260 degrees F., which attach the PCD insert or bit 12 to the forward end of the carbide insert 80. The liquidus of the brazing discs 98, 100 material is much lower, 1260 degrees F., than the liquidus of the brazing rings 97, 99 material (FIG. 3), which are brazed at 1700 degrees F. Each brazing disc and brazing ring suitably sized to fit the dimensions of the bit holder.

The annular steel sleeve 86 not only extends the useful life of the diamond tool throughout the manufacturing process by eliminating scrap due to mishandling, but also extends the useful life of the diamond tool in removing macadam from road surfaces. The heat generated, when the PCD insert or bit 12 of bit assembly 10 is removing macadam, dissipates faster through the annular steel sleeve 86. Steel materials transfer heat approximately five times faster than tungsten carbide. In using the annular steel sleeve 86 to shield the carbide insert 80, the service life of the bit assembly 10 is increases the useful life of a PCD insert brazed atop a tungsten carbide bolster alone.

Figure 7:
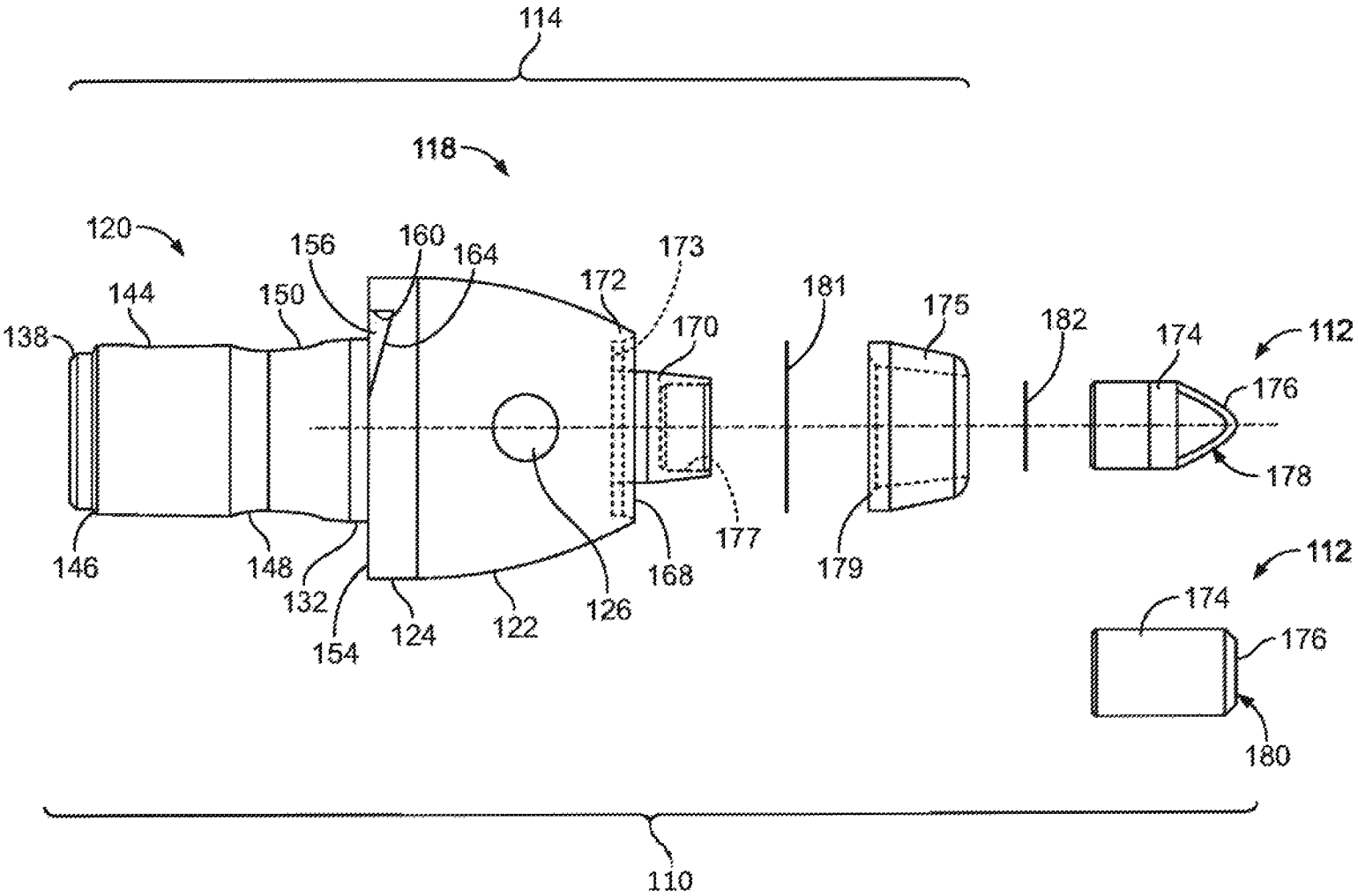
FIG. 7 is a detail exploded side elevation view of the second embodiment of the bit holder, showing an annular carbide collar and a metal sleeve and the bit or insert, with either a frustoconical forward end or a flat generally cylindrical puck forward end.

Referring to FIGS. 6 and 7, a second embodiment of a bit assembly 110 (not shown), or diamond tool, comprises a bit or insert 112, a bit holder 114, and a base block 116 (not shown). The combination bit and bit holder of the present disclosure is a unitary bit and bit holder construction that includes a bit holder body 118 and a generally cylindrical hollow shank 120 (FIGS. 6, 7) axially depending from the bottom of the bit holder body 118. In this embodiment, the bit holder body 118 is generally annular in shape and comprises an enlarged upper body 122 having a tire portion 124 and a cylindrical side wall extending upwardly from the tire portion 124 to the upper body 122. The upper body 122 of the bit holder body 118, in this embodiment, is a generally convex surfaced solid structure. In other embodiments, the enlarged upper body 122 can have various shapes, such as having a generally frustoconical, concave, or arcuate surfaced solid structure. In this embodiment, the enlarged upper body 122 includes an aperture 126 that accepts an insertion sleeve to facilitate inserting the bit holder 114 into the base block 116.

The bit holder body 118 of the bit/bit holder combination provides added bulk and strength to the entire unitary assembly which allows the bit/bit holder combination of the present disclosure to withstand substantial forces and stress superior to heretofore known bit holders or bit/bit holder combinations. The present disclosure may be utilized not only in the degrading and removal of macadam or asphalt from long straight stretches of roadway, but may also provide for the removal of concrete and other materials both in straight long stretches and in curved sections such as at corners, cloverleaf intersections, or the like.

The shank 120 includes a central bore 128 (not shown) that longitudinally and axially extends throughout the shank 120 of the bit holder body 118 of the bit/bit holder combination. The central bore 128 terminates, in this embodiment, at bore termination 130 (not shown) that is approximately at a generally cylindrical forward portion 132 of the shank 120. A sidewall 134 (not shown) of the shank 120, created by the central bore 128, further includes an elongated slot 136 (not shown) extending from a generally annular distal end 138 of the shank 120 axially upward or forward to an upper termination 140 (not shown) that is adjacent to the upper or forward portion 132 of the shank 120. This allows the generally C-shaped annular sidewall 134 of the shank 120 to radially contract when the shank 120 is mounted in one of a positively tapered, cylindrical, or negatively tapered base block bore 142 (not shown) in the base block 116.

The shank 120 includes a lower or first tapered portion 144 running axially from a stepped shoulder 146 adjacent the distal end 138 of the shank 120. The first tapered portion 144 runs upwardly or axially from the stepped shoulder 146 of the shank 120 and terminates generally mid slot 136 (not shown) longitudinally. The shank 120 also includes a second tapered portion 148 separating the first tapered portion 144 from an upper or third tapered portion 150 which extends from the second tapered portion 148 to the generally cylindrical forward portion 132 of the shank 120. The generally cylindrical forward portion 132 extends from the third tapered portion 150 towards a generally annular back flange 154 that denotes the base of the bit holder body 118 of the bit holder 114. In other embodiments, the forward portion 132 can also be positively or negatively tapered.

The generally annular flange 154 includes a pair of tapered cutouts 156 (FIGS. 6 and 7), 158 (not shown), or wedge-shaped undercuts, to provide access and leverage for a tool to extract the bit holder 114 from the base block 116 (not shown). The tapered cutouts 156, 158 are formed into the tire portion 124 and extend from the flange 154 subjacent to the tire portion 124. The tapered cutouts 156, 158 include a pair of parallel flat vertical inner surfaces 160 (FIGS. 6 and 7), 162 (not shown), respectively, and a pair of flat tapered top surfaces 164 (FIGS. 6 and 7), 166 (not shown), respectively. The outer edge of the flat tapered top surfaces 164, 166 is each arcuate in shape to follow the periphery of the tire portion 124.

The upper body 122 of the bit holder body 118 includes a generally annular top surface 168 positioned perpendicular to the axis of the bit holder 114 from the interior of which axially extends a smaller radially oriented annular tapered upper or forward extension 170. A forwardly extending annular collar 172 is created on the bit holder body 118 to provide an annular trough 173 (FIG. 7) around the tapered upper extension 170 of the bit holder body 118, as shown in FIG. 7. An annular carbide collar 175 is fitted around the tapered upper extension 170, which may be brazed into unitary construction with the remainder of the bit holder 114. A top or forwardmost portion of the carbide collar 175 and the annular tapered upper extension 170 of the upper body 122 terminate generally at the top of the bit holder body 118 of the combination bit/bit holder.

With the bit holder body 118 of the present disclosure preferably made of 4340 or equivalent steel, the top of the upper extension 170 of the upper body 122 includes a cylindrical bore 177 extending from the co-terminal upper wall of the body axially inwardly thereof. The bore 177 extends a short distance longitudinally axially inwardly of the annular upper extension 170 that defines the base for the tip base 174 of the bit tip 112, which may be positioned and brazed therein to provide a unitary structure. In other embodiments, the upper extension 170 can include a radially declining tapered bore, a generally cylindrical bore, or a bore with a slight draw or draft angle.

The tip base 174 may be made of steel or tungsten carbide and includes a tip at the outer or upper end of the bit tip. In this embodiment, the outer surface or upper end 176 of tip 112 is made of a polycrystalline diamond structure. The upper end 176 of the tip 112 can have a frustoconical shape 178, a flat generally cylindrical puck shape 180, or an arcuate shape (not shown). The upper end 176 of the bit tip 112 may also be made of an industrial diamond material and may be a coating or outer layer of such industrial diamond material, natural diamond, or polycrystalline diamond (PCD) material. The coating or layer may be formed of a high pressure, high temperature process.

The flat generally cylindrical puck shape 180 upper end 176 of the bit 112 of the bit holder 114, shown in FIGS. 6 and 7, provides a substantially stronger tip that is able to withstand the added forces and peak jolts found in degrading concrete and the like, and together with the added bulk of the bit holder body 118 of the illustrated bit/bit holder combination, is capable of removing or degrading concrete surfaces with the added life expectancy shown in prior bit/bit holder constructions with PCD tips that have heretofore been utilized only in removing long straight stretches of macadam. A road milling machine can travel faster with forward speed using the instant bit/bit holders than it can with bit holders having a strictly tungsten carbide forward end.

The bit holder 114 is assembled using a two-step brazing process. As previously described with regard to the first embodiment, parts of the bit holder 114 that are to be brazed together are first treated through a fluxing process. The parts are fluxed to clean, promote melting, and protect the parts from oxidation. In preparation for the brazing process, as shown in FIG. 7, a brazing ring 181 is positioned and mounted in the annular trough 173 of the bit holder body 118 and the carbide collar 175 is positioned and mounted into the annular trough 173 such that a bottom portion 179 (FIG. 7) of the carbide collar 175 rests on the brazing ring 181. The carbide collar 175 is brazed to the bit holder body 118 by melting brazing ring 181 and then the combination bit holder body 118 and the carbide collar 175 is heat treated. After the bit holder has been heat treated, a brazing disc 182 is positioned and mounted in the bore 177 of the forward extension 170 and the hardened tip 112 is then positioned and mounted in the bore 177 of the forward extension 170 such that the base 174 of the tip 112 rests on the brazing disc 182. The braze material of brazing disc 182 has a lower melting point than the braze material used in brazing ring 181. The lower liquidus temperature of approximately 300 degrees F. of brazing disc 182 ensures that brazing ring 181 will not melt when the base 174 of the tip 112 is brazed to the forward extension 170 of the bit holder 114, by melting brazing ring 182 to approximately 1300 degrees F. The fully assembled tool is then ready for the brazing process where the tip 112 is brazed directly into the forward extension 170 of the steel upper body 122 of the bit holder 114.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder for road milling machinery comprising:

a substantially solid body comprising an upper end and a lower end, the upper end being diametrically smaller than the lower end;

a generally cylindrical hollow shank depending axially from the lower end, the shank comprising a bore axially extending from a distal end of the shank toward a forward body portion;

an annular forward extension axially extending from the upper end of the body, the forward extension being diametrically smaller than the upper end;

a bore axially extending inwardly from a forward end of the forward extension;

a carbide insert comprising a generally cylindrical bore, wherein the carbide insert is disposed within the bore of the forward extension; and a steel annular sleeve disposed circumferentially around a forward end of the carbide insert, the sleeve configured to receive a bit.

2. The bit holder of claim 1, further comprising:

a receiving cup mounted within the generally cylindrical bore of the carbide insert.

3. The bit holder of claim 2, wherein the receiving cup is a steel cup comprising a bottom portion and an annular flange extending upwardly from a circumference of the bottom portion, the annular flange defining a hollow forward portion of the receiving cup configured to receive the bit.

4. The bit holder of claim 3, the bottom portion comprising one of a first predetermined thickness and a second predetermined thickness, the first predetermined thickness less than the second predetermined thickness.

5. A bit holder for road milling machinery comprising:

a substantially solid body comprising an upper end and a lower end, the upper end being diametrically smaller than the lower end;

a generally cylindrical hollow shank depending axially from the lower end, the shank comprising a bore axially extending from a distal end of the shank toward a forward body portion;

an annular forward extension axially extending from the upper end of the body, the forward extension being diametrically smaller than the upper end;

a carbide collar disposed around the forward extension; and a steel annular sleeve axially extending from the annular forward extension, the sleeve configured to receive a bit.

6. The bit holder of claim 5, wherein a distal end of the steel annular sleeve rests on a forward end of the carbide collar.

7. A bit holder for road milling machinery comprising:

a substantially solid body comprising an upper end and a lower end, the upper end being diametrically smaller than the lower end;

a generally cylindrical hollow shank depending axially from the lower end, the shank comprising a bore axially extending from a distal end of the shank toward a forward body portion;

an annular trough extending inwardly from the upper end of the body;

an annular collar disposed in the annular trough, the annular collar extending forwardly from the annular trough; and a steel annular sleeve axially extending from a collar forward end of the annular collar, the sleeve configured to receive a bit.

8. The bit holder of claim 7, wherein the annular trough is disposed around a forward extension axially extending from the annular trough, the forward extension being diametrically smaller than a top surface of the upper end of the body.

9. The bit holder of claim 7, wherein the annular collar is an annular carbide collar.

10. The bit holder of claim 7, wherein a distal end of the steel annular sleeve rests on a forward end of the annular collar.

* * * * *